US008020505B1

(12) United States Patent
Galway

(10) Patent No.: US 8,020,505 B1
(45) Date of Patent: Sep. 20, 2011

(54) PROBE RECEIVER DEVICE FOR RECOVERING SURFACE WATER VESSELS

(75) Inventor: Robert J. Galway, Virginia Beach, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 681 days.

(21) Appl. No.: 12/079,063

(22) Filed: Mar. 3, 2008

(51) Int. Cl.
*B63B 21/56* (2006.01)
*B63B 21/58* (2006.01)
*B63G 8/42* (2006.01)

(52) U.S. Cl. ..... 114/249; 114/250; 114/252

(58) Field of Classification Search ..... 114/242, 114/244, 245, 249–253, 258, 322
See application file for complete search history.

(56) References Cited

U.S. PATENT DOCUMENTS

| | | | | |
|---|---|---|---|---|
| 3,461,829 | A * | 8/1969 | Mosvold | 114/246 |
| 3,830,186 | A * | 8/1974 | Janssen et al. | 114/249 |
| 3,943,875 | A * | 3/1976 | Sanders | 114/244 |
| 5,746,150 | A | 5/1998 | Beaulac et al. | |
| 6,257,162 | B1 | 7/2001 | Watt et al. | |
| 6,600,695 | B1 | 7/2003 | Nugent et al. | |
| 7,506,606 | B2 * | 3/2009 | Murphy et al. | 114/368 |

* cited by examiner

*Primary Examiner* — Ajay Vasudeva
(74) *Attorney, Agent, or Firm* — Dave A. Ghatt

(57) ABSTRACT

A method and apparatus for securing a surface water vessel to a floating station. The surface water vessel may be an unmanned surface vehicle, and the floating station may be attached to a larger parent ship. According to the invention, the surface water vessel includes a forwardly projecting elongated probe and the floating station includes a receiver having a receiver opening for receiving the elongated probe therein. The elongated probe includes a spherical tip having a circumferential groove. The receiver includes movable spheres that are moved into engagement with the circumferential groove, thereby locking the probe within the receiver. This locking arrangement secures the surface water vessel to the floating station.

6 Claims, 5 Drawing Sheets

PROBE RECEIVER DEVICE FOR RECOVERING SURFACE WATER VESSELS

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

TECHNICAL FIELD

The following description relates generally to a method and apparatus for recovering a surface water vessel, and in particular, a probe and receiver arrangement for latching a surface water vessel to a floating station.

BACKGROUND

The recovery of smaller surface water vessels, such as manned or unmanned surface water vessels (USVs), by larger parent ships is an emerging technology. Once recovered by the parent ship, servicing operations may be performed. Typically, the recovery of a smaller vessel is accomplished by driving the smaller vessel alongside a stationary parent ship and lifted by davit into the ship. Alternatively, the smaller water vessel may be driven up a ramp into the larger ship.

Traditional methods of capturing smaller surface water vessels can cause damage to the hull of the smaller vessel. For example, some USVs weigh about 20,000 lbs and are made from materials such as aluminum. A capturing method that for example, requires the USV to be driven into a parent ship or be lifted and dropped onto the parent ship can cause damage to the aluminum hull, resulting in expensive repairs. It is desired to have a method and apparatus that captures the smaller vessel in a controlled manner away from the parent ship. It is further desired to have a method and apparatus that draws the smaller vessel onto the parent ship in a controlled manner. It is also desired to capture a smaller surface water vessel away from the larger ship in order to perform servicing operations, independent of the parent ship.

SUMMARY

In one aspect, the invention is a latching arrangement for securing a water vessel to a floating station. According to the invention, the latching arrangement includes a cylindrical probe having a support end and a free end. The free end has a spherical tip, with the spherical tip having a circumferential groove therein. In this aspect, the latching arrangement includes a receiver. The receiver has a conical front having a cone shaped opening for receiving the cylindrical probe through the cone shaped opening. The receiver further includes a securing block attached to the conical front, with the securing block having a spherical opening for receiving the spherical tip of the cylindrical probe. In this aspect, the latching arrangement further includes a clamping arrangement attached to the securing block. The clamping arrangement has a plurality of movable holders that are movable into the circumferential groove of the cylindrical probe for securing the cylindrical probe in the securing block.

In another aspect, the invention is a latching system for securing a water vessel. The latching system includes a water vessel having a bow and a stern. The latching system also includes an elongated probe having a first end attached to the bow of the water vessel and a second free end having a spherical tip. The spherical tip has a circumferential groove. The system includes a floating station with a floating station body having a receiver side. In this aspect, the system includes a receiver attached to the receiver side of the floating station. The receiver has a conical front protruding from the receiver side of the floating station. The conical front has a cone shaped opening for receiving the elongated probe through the cone shaped opening. The system further includes a securing block attached to the conical front, the securing block having a spherical opening for receiving the spherical tip of the elongated probe. A clamping arrangement attached to the securing block is also included. The clamping arrangement has a plurality of hydraulically activated displaceable spheres movable into the circumferential groove of the elongated probe for securing the elongated probe in the securing block.

In another aspect, the invention is a method of servicing a water vessel. The method includes the providing of a floating station having a body with a receiver side. In this aspect, the method includes the providing of a receiver attached to the receiver side of the floating station, with the receiver having a receiver opening. The method further includes the providing of a water vessel with an elongated probe projecting forwardly from the bow of the water vessel, and the directing the elongated probe of the water vessel into the receiver opening of the receiver. This is achieved by directing the water vessel towards the floating station. The method of servicing the water vessel further includes the detecting of when the probe is fully inserted into the receiver opening, and upon detecting the full insertion of the probe in the receiver, securely fastening the probe in the receiver.

BRIEF DESCRIPTION OF THE DRAWINGS

Other features will be apparent from the description, the drawings, and the claims.

DETAILED DESCRIPTION

Figure 1:
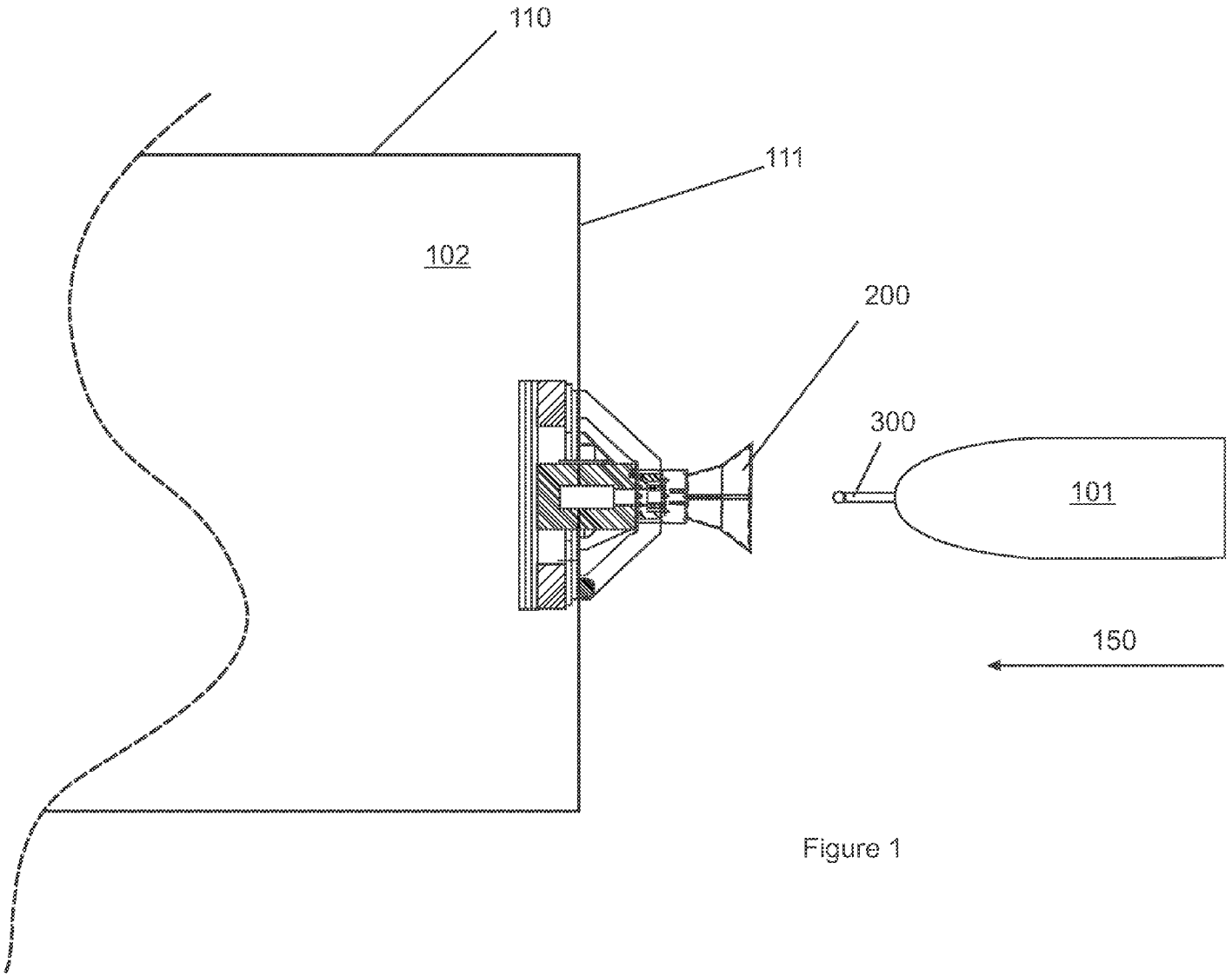
FIG. 1 is an exemplary illustration of a latching system for attaching a water vessel to a floating station according to an embodiment of the invention.

FIG. 1 is an exemplary illustration of a latching system 100 for attaching a surface water vessel 101 to a floating station 102 according to an embodiment of the invention. FIG. 1 schematically shows the surface water vessel 101, which may be an unmanned surface vessel having a forwardly projecting elongated probe 300 at the bow 103 of the water vessel 101. As will be outlined below, the vertical positioning of the probe on the bow 103 can be adjusted, using an adjustment mechanism.

FIG. 1 shows the floating station 102 of the latching system 100 being a body 110 having a receiver side 111. The body 110 may be a solid structure or an inflated structure, and may have any desired shape, such as for example, rectangular, oval, oblong, circular, or irregular. The floating station 102 preferably has a weight and dimensions that allows it to ably support an attached water vessel. When the body 110 is an inflated structure, the body may be made from a material such as natural rubber, urethane rubber, fluororubber, silicone rubber, elastomers, plastics, and the like. The floating station 102 may be attached to a parent ship. As shown, the latching system 100 further includes a receiver 200 attached to the floating station 102 at the receiver side 111 of the floating station 102. The receiver 200 may be attached to, and stabilized on the floating station 102 by using one or more attachment devices such as clamps, struts, and the like.

Figure 2B:
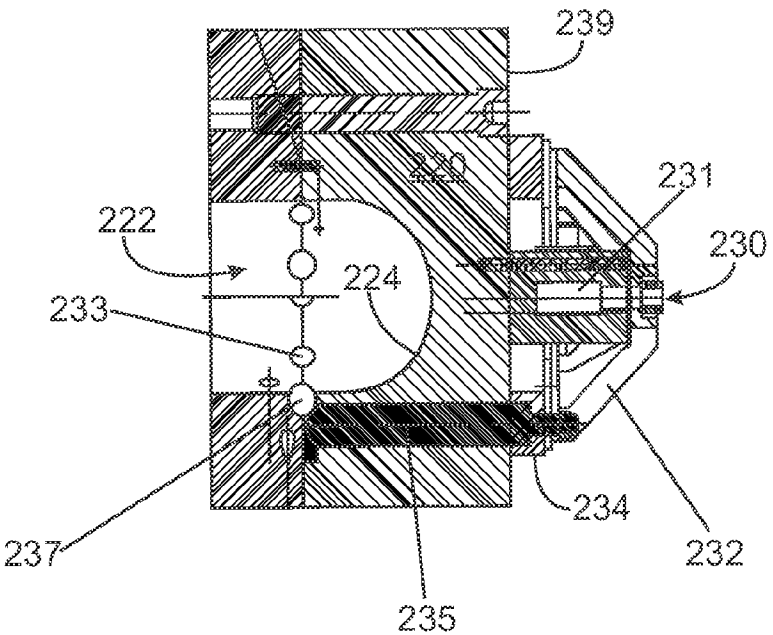
FIG. 2B is an exemplary section of a securing block according to an embodiment of the invention.
Figure 2A:
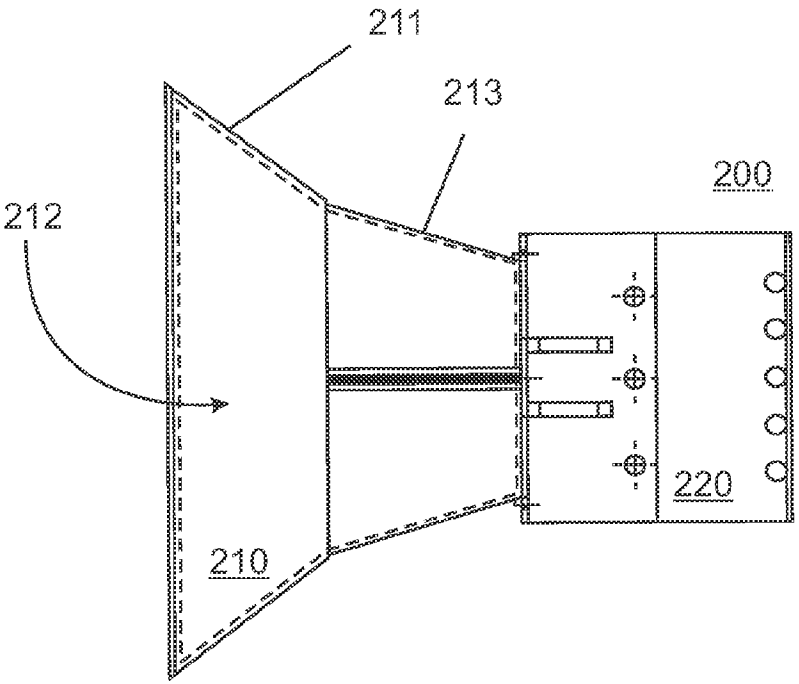
FIG. 2A is an exemplary illustration of a receiver for receiving a probe according to an embodiment of the invention.

FIG. 2A is an exemplary illustration of the receiver 200 for receiving the elongated probe 300 therein. The receiver 200 includes a funnel-like conical front 210 having an opening 212 for receiving the probe 300 therethrough. The conical front 210 includes a first flared portion 211 and a second flared portion 213, the second flared portion having a reduced flare as compared to the first portion. As shown in FIG. 1, the conical front 210 protrudes from the receiving side 110 of the floating station 102.

Figure 2D:
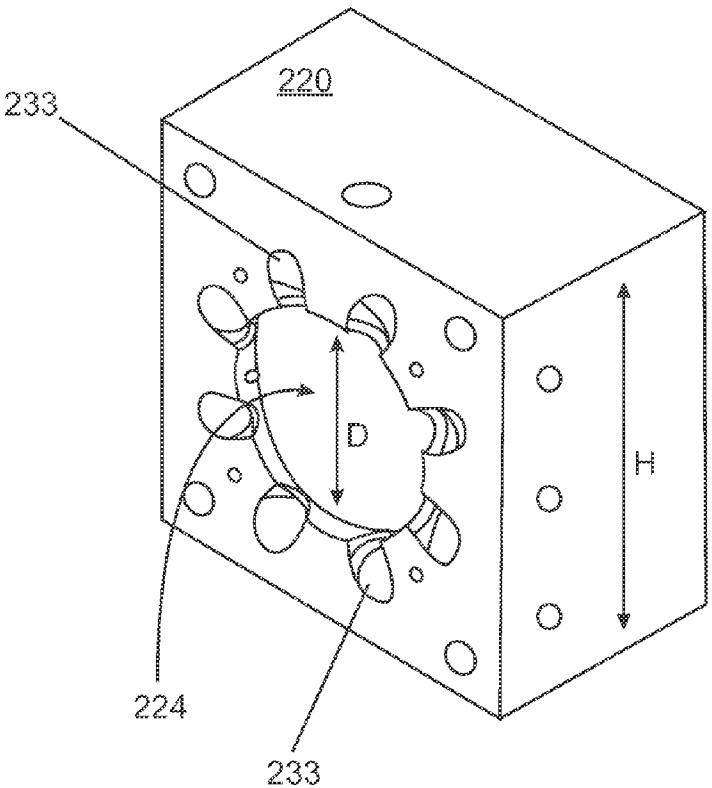
FIG. 2D is a perspective view of a securing block according to an embodiment of the invention.
Figure 2C:
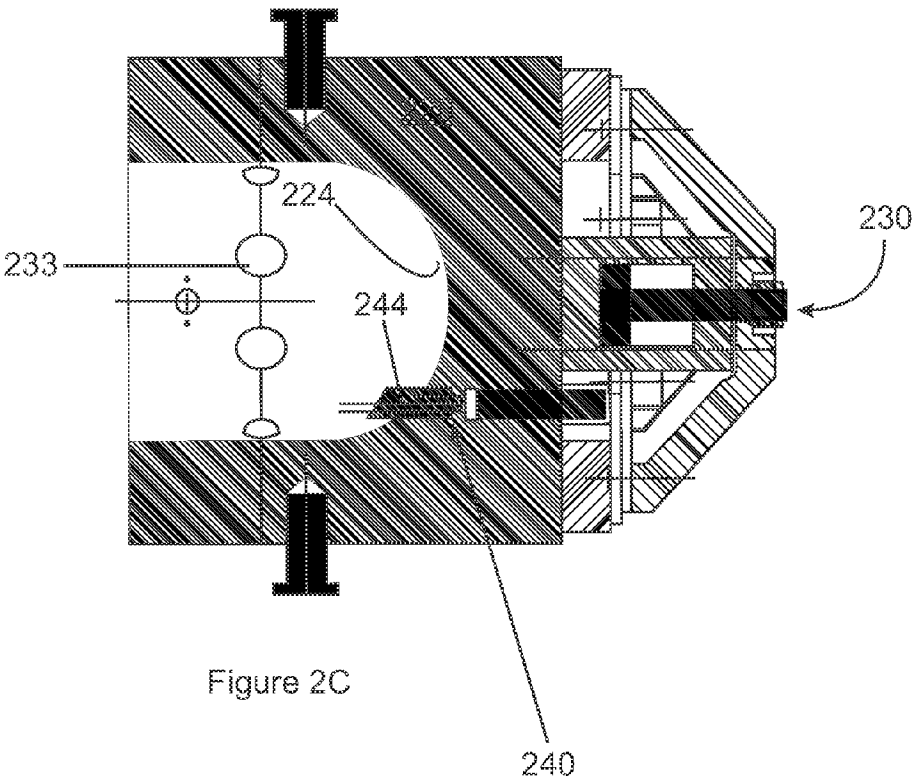
FIG. 2C is an exemplary section of a securing block according to an embodiment of the invention.

FIGS. 2B-2D show the securing block 220, with FIGS. 2B and 2C providing sectional illustrations and FIG. 2D providing a perspective view. FIG. 2B shows the block 220 having an opening 222 which forms a continuous opening with the conical front opening 212 of the conical front 210. As shown, the opening 222 has spherical portion encompassed by a spherical receiving surface 224. As outlined below, the spherical receiving surface 224 corresponds to a spherical tip of the elongated probe 300. The receiver 200, and particularly the receiving surface 224 may be made of an age-hardened stainless steel, such as 17-4 PH. FIG. 2B also shows a clamping arrangement located generally at the back side 239 of the securing block 220 and extending towards the opening 222. The clamping arrangement includes a hydraulic device 230 having a hydraulic cylinder 231, a plurality of tines 235, a plurality of lateral channels 233, and a plurality of movable holders, spheres or balls 237. The spheres 237 are radially displaceable by movement in the lateral channels 233. The hydraulic cylinder 231 is operatively attached to the plurality of tines 235 via a plurality of connection arms 232, each arm connected at one end to a central hub on the hydraulic cylinder 231, and at another end connected to a single circular connecting ring 234. As shown, each tine 235 is attached to the circular ring 234. When the hydraulic cylinder 231 retracts, the plurality of connection arms 232 push the circular connecting ring 234 and the attached plurality of tines 235. Substantially simultaneously, the tines 235 push the plurality of spheres 237 along the channels 233 to engage and securely lock the elongated probe 300 when the probe is inserted in the receiver 200.

FIG. 2D illustrates a perspective view of the lateral channels 233. FIG. 2D shows eight channels 233 for supporting and directing eight spheres 237, which are moved by eight corresponding tines. The spheres 237 are arranged so that when they engage the elongated probe 300 the spheres are substantially evenly distributed around the probe 300. It should be noted that the clamping arrangement may include as many tines 235 and spheres 237 as desired for securely locking the probe 300. In other words, the clamping arrangement may have more than eight tines 235 and spheres 237 or less than eight tines 235 and spheres 237. It should also be noted that the number of connection arms 232 may match the number of tines 235 and spheres 237.

FIG. 2C illustrates a section of securing block 220, different from section shown in FIG. 2B. The section of FIG. 2C shows a sensing device 240 having a spring biased plunger 244. The plunger 244 protrudes above the spherical receiving surface 224, and is retractable into the surface 224. In operation, when the probe 300 is fully inserted into the receiver, the probe 300 pushes the spring biased plunger 244 into the receiving surface 224. As will be outlined below, when the plunger 244 is pushed in, the sensor 240 detects the insertion of the probe 300. The sensor 240 has a sensing range of about 5 mm (0.197 inches). As shown in FIG. 2D, the receiving block has a height H, and the opening 222 in the securing block has a diameter D. In one particular embodiment, the height H may be about 9 inches and the diameter D may be about 5 inches.

Figure 3A:
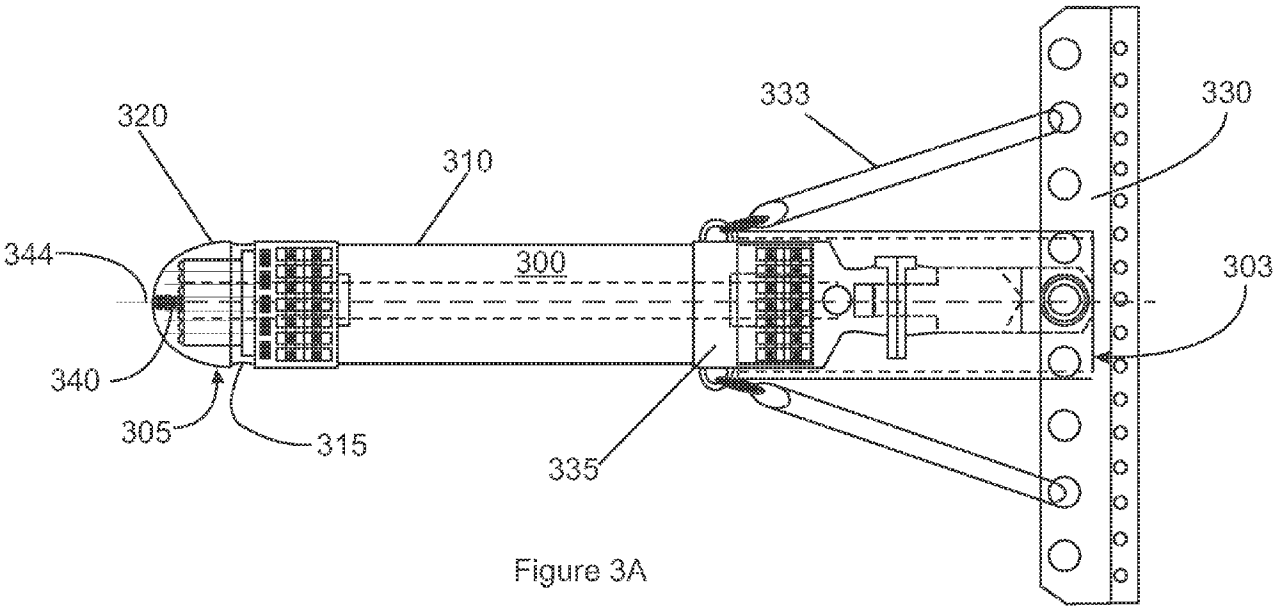
FIG. 3A is an exemplary illustration of an elongated probe according to an embodiment of the invention.

FIG. 3A is an exemplary illustration of an elongated probe 300 according to an embodiment of the invention. As shown, the probe 300 has a support end 303 and a free end 305. The probe further includes an elongated shaft section 310, and an adapter section 330 at the support end 303 of the probe. The adapter section 330 is for mounting the probe to the bow 103 of a water vessel, and allows for the vertical adjustability of the probe on the bow. Typically, the adapter mates with a mounting plate attached to the bow 103, wherein the adapter 330 is mountable at different locations on the mounting plate. FIG. 3A also shows a stability and flexibility arrangement which includes a plurality of elastic chords 333 extending from the adapter section to a support ring 335, which is mounted on the shaft 310 of the probe.

FIG. 3A also shows the probe 300 having a substantially spherical tip 320 at the free end 305, which corresponds to the spherical receiving surface 224 in the receiver 200. The spherical tip 320 may be made of an age-hardened steel such as 17-4 PH. The spherical tip 320 may have a diameter that is substantially equal to the diameter D of the opening in the securing block 220 to allow for a proper mating relation between the elements. Therefore, in the embodiment in which the diameter D of the opening is about 5 inches, then the diameter of the spherical tip 320 is substantially equal to about 5 inches. As shown, the spherical tip 320 includes a circumferential groove 315. As will be outlined below, the secure latching of the probe 300 in the receiver 200 is achieved when the balls or spheres 237 are pushed and locked into the circumferential groove 315 of the probe. FIG. 3A also shows a sensing device 340 having a spring biased plunger 344. The plunger 344 protrudes above the surface of the spherical tip 320, and is retractable into the surface. In operation, when the probe 300 is fully inserted into the receiver, the probe receiving surface 224 pushes the spring biased plunger 344 into the surface at the spherical tip 320. As will be outlined below, when the plunger 344 is pushed in, the sensor 340 detects the insertion of the probe 300. The sensor 340 has a sensing range of about 5 mm (0.197 inches).

The operation of the latching system in which a floating station 102 captures a water vessel 101 is as follows. As outlined above, the surface water vessel may be an unmanned surface vessel, and the floating station may have any desired shape, such as for example, rectangular, oval, oblong, circular, or irregular. As shown in FIG. 1, the vessel 101 having the forwardly projecting probe 300, traveling in direction 150, approaches the floating station 102. When the floating vessel 102 comprises an inflated material, damage to the vessel hull caused by contact between the bodies is minimized. As the vessel approaches the floating station 102, the elongated probe 300 contacts the conical front 210 of the receiver 200.

The flared portions 211 and 213 of the conical front 210 smoothly direct the elongated probe 300 towards the opening 222 of the securing block.

Figure 3B:
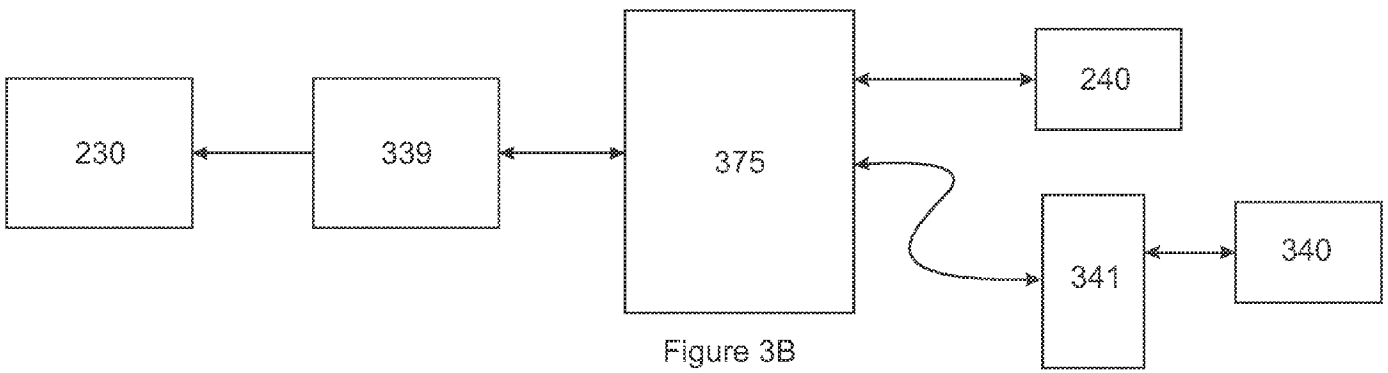
FIG. 3B is a schematic illustration of a controller arrangement according to an embodiment of the invention.

As outlined above, a first sensor 340 is positioned on the spherical tip 320 of the elongated probe 300, and a second sensor 240 is positioned on the spherical receiving surface 224. When the elongated probe 300 is inserted in the receiver 200, the plungers 344 and 244 of the first and second sensors respectively are depressed into respective surfaces. When the plungers 344 and 244 are depressed, the respective sensors 340 and 240 transmit signals to a system controller 375. See FIG. 3B. As shown in FIG. 3B, the sensor 240 transmits signals directly to the system controller 375. The sensor 340 transmits signals to a vessel controller 341 which is located on the vessel 101. The vessel controller 341 then transmits the signals to the system controller 375. A wireless transmission system such as an infrared system or the like may be used to transmit signals between the vessel controller 341 and the system controller 375. When the controller 375 receives the depressed signal from both sensor 340 and sensor 240, then the controller 375 determines that the probe 300 is fully inserted in the receiver 200. The requirement for the receipt of both signals by the controller safeguards against the inadvertent activation of one of the plungers. However, in another embodiment of the invention, the controller 375 may be responsive to a depressed signal from only one of the first or second sensors.

After the controller 375 determines that the probe 300 is fully inserted, the controller 375 transmits a signal to initiate a hydraulic power unit 339 of the hydraulic device 230. The hydraulic power unit 339 then powers up the hydraulic cylinder 231, which retracts and moves the eight connected tines 235 via the plurality of connection arms 232 and the circular connecting ring 234. Each tine 235 pushes a corresponding sphere 237 in a corresponding lateral channel 233 so that each sphere 237 engages the spherical tip 320 of the probe 300. The spheres 237 engage the spherical tip 320 within the circumferential groove 315, thereby wedging and locking the probe 300 within the receiver 200. Because the probe 300 is locked in the receiver 200, the vessel 101 is secured to floating station 102. As outlined above, both the spherical tip 320 and the receiver 200 may be made of an age-hardened stainless steel material such as 17-4 PH. This stainless steel material meets corrosion resistance and strength requirements associated with the latching of the water vessel 101 to the floating station 102 in open water conditions. Additionally, the elongated shaft 310 may be made of a polymer material, which enhances the flexibility and operational capabilities of the device. However, the elongated shaft may also be made from non-polymer materials.

The floating station 102 may be attached, via a line or other known means, to a parent ship. Once the vessel 101 is secured by the floating station 102, the vessel may be transported to the parent ship along with the floating station, where servicing or other functions may take place. Alternatively, servicing such as refueling or recharging of energy supplies may be performed on the vessel in the locked state, without transporting back to the parent ship. For example, the floating station 102 may include a fuel supply for providing fuel to the water vessel 101. The floating station 102 may also be equipped to provide a secure information transfer with the vessel 101.

Figure 4:
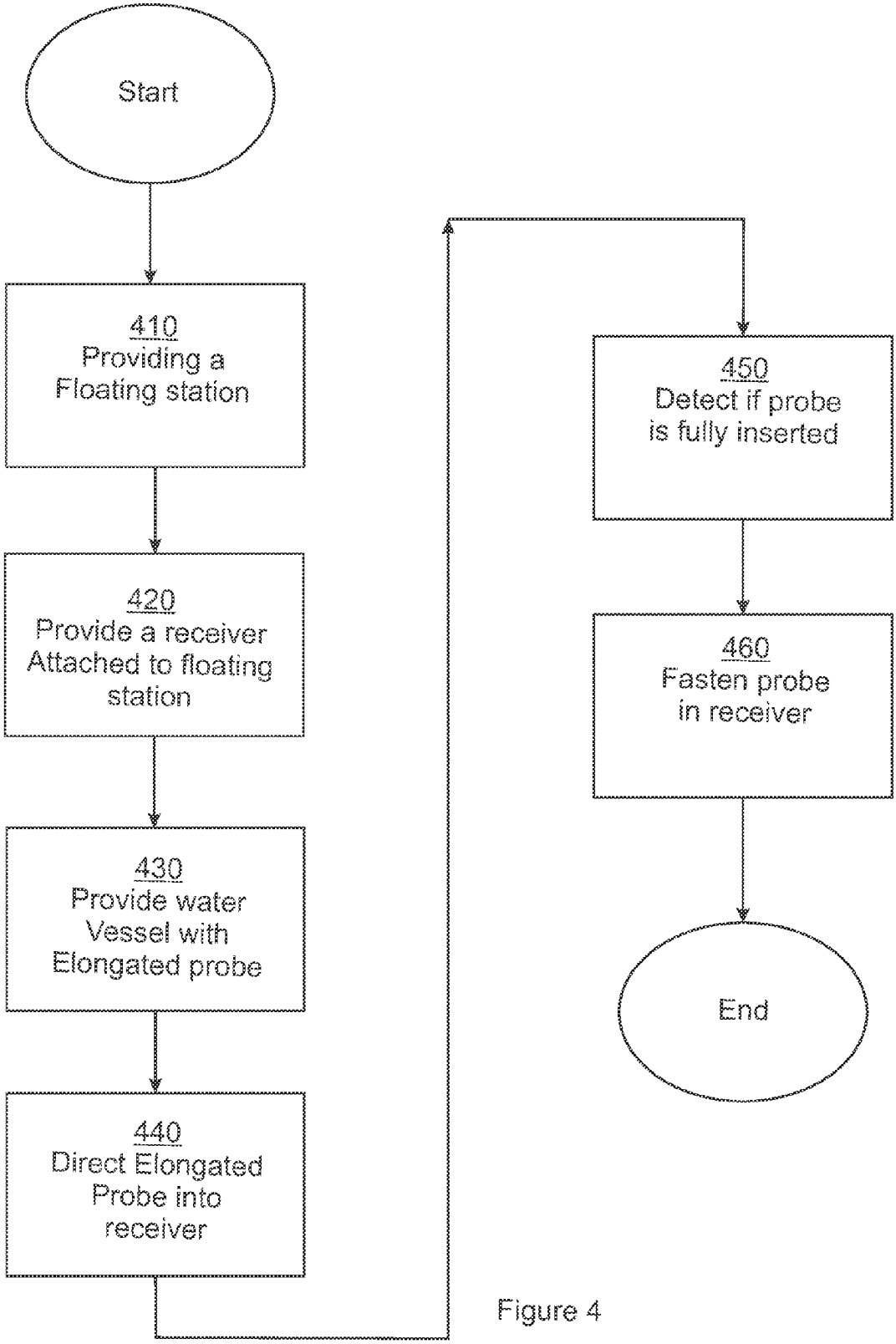
FIG. 4 is a flowchart illustrating a method of servicing a water vessel according to an embodiment of the invention.

FIG. 4 is a flowchart illustrating a method 400 of servicing a water vessel according to an embodiment of the invention. The steps involved in the method 400 of servicing a water vessel have been outlined above in detail in the description with respect to FIGS. 1-3B. Step 410 is the providing of the floating station. As shown in FIG. 1 and as outlined above, the floating station 102 has a body 110 having a receiver side 111. As outlined above, the floating station 102 may have any desired shape, such as for example, rectangular, oval, oblong, circular, or irregular.

Step 420 is the providing of the receiver 200 attached to the receiver side 111 of the floating station 102. As illustrated in FIGS. 2A-2D, the receiver has a continuous opening that is commensurate with the shape of the elongated probe 300. Step 430 is the providing of the elongated probe projecting forwardly from the bow of the water vessel. Step 440 is the directing of the elongated probe 300 of the water vessel 101 into the receiver opening 212 of the receiver by directing the water vessel 101 in direction 150 towards the floating station 102, as shown in FIG. 1.

Step 450 is the detecting when the probe is fully inserted into the receiver opening. As outlined above, first and second sensors 340 and 240 are used to detect the full insertion of the probe 300. Step 460 is the fastening of the probe in the receiver, upon the detection of the full insertion of the probe 300 in the receiver 200. As outlined above and as shown in FIG. 3B, the controller 375 receives signals from the sensors 340 and 240 indicating that the probe is inserted. If the controller 375 determines that the probe 300 is fully inserted, the controller activates the hydraulic device 230, which pushes the spheres 237, via tines 235, into engagement with the circumferential groove 315 in the spherical tip 320 of the probe 300.

What has been described and illustrated herein are preferred embodiments of the invention along with some variations. The terms, descriptions and figures used herein are set forth by way of illustration only and are not meant as limitations. Those skilled in the art will recognize that many variations are possible within the spirit and scope of the invention, which is intended to be defined by the following claims and their equivalents, in which all terms are meant in their broadest reasonable sense unless otherwise indicated.

What is claimed is:

1. A latching system for securing a water vessel, the latching system comprising:

a water vessel having a bow and a stern;

an elongated probe having a first end attached to the bow of the water vessel and a second free end having a spherical tip, the spherical tip having a circumferential groove therein;

a floating station having a body, the body having a receiver side;

a receiver attached to the receiver side of the floating station, the receiver comprising:

a conical front protruding from the receiver side of the floating station, the conical front having a cone shaped opening for receiving the elongated probe through the cone shaped opening;

a securing block attached to the conical front, the securing block having a spherical opening for receiving the spherical tip of the elongated probe; and a clamping arrangement attached to the securing block, the clamping arrangement having a plurality hydraulically activated displaceable spheres movable into the circumferential groove of the elongated probe for securing the elongated probe in the securing block;

a first sensor protruding from a surface of the spherical tip of the elongated probe, for detecting when the elongated probe is fully inserted in the receiver, said first sensor transmitting a first signal indicating that the elongated probe is inserted; and a second sensor protruding from an inner surface of the securing block, for detecting when the elongated probe is fully inserted in the receiver, said second sensor transmitting a second signal indicating that the elongated probe is inserted.

2. The latching system of claim 1 further comprising:

a controller electronically connected to the first sensor, the second sensor, and the hydraulically activated spheres, wherein when the controller receives said fully inserted signals from the first sensor and the second sensor, the controller determines that the probe is fully inserted in the receiver, the controller then initiates the movement of the spheres into the circumferential groove of the spherical tip.

3. The latching system of claim 2, wherein the spherical tip of the probe has a diameter of about 5 inches and the first sensor protruding from the surface of the spherical tip is a spring biased plunger with a 0.197 inch sensing range, and wherein the diameter of the spherical opening in the securing block is about 5 inches, the securing block has a height of about 9 inches, and the second sensor protruding from an inner surface of the securing block is a spring loaded plunger with a 0.197 inch sensing range.

4. The latching system of claim 3, wherein the water vessel is an unmanned surface vessel.

5. The latching system of claim 4, wherein each of the spherical tip and the receiver comprise an age-hardened stainless steel material.

6. A latching system for securing a water vessel, the latching system comprising:

a water vessel having a bow and a stern, said vessel being an unmanned surface vessel;

an elongated probe having a first end attached to the bow of the water vessel and a second free end having a spherical tip, the spherical tip having a circumferential groove therein;

a floating station having a body, the body having a receiver side;

a receiver attached to the receiver side of the floating station, the receiver comprising:

a conical front protruding from the receiver side of the floating station, the conical front having a cone shaped opening for receiving the elongated probe through the cone shaped opening;

a securing block attached to the conical front, the securing block having a spherical opening for receiving the spherical tip of the elongated probe; and a clamping arrangement attached to the securing block, the clamping arrangement having a plurality hydraulically activated displaceable spheres movable into the circumferential groove of the elongated probe for securing the elongated probe in the securing block;

a first sensor protruding from a surface of the spherical tip of the elongated probe, for detecting when the elongated probe is fully inserted in the receiver, said first sensor transmitting a first signal indicating that the elongated probe is inserted;

a second sensor protruding from an inner surface of the securing block, for detecting when the elongated probe is fully inserted in the receiver, said second sensor transmitting a second signal indicating that the elongated probe is inserted; and a controller electronically connected to the first sensor, the second sensor, and the hydraulically activated spheres, wherein when the controller receives said fully inserted signals from the first sensor and the second sensor, the controller determines that the probe is fully inserted in the receiver, the controller then initiates the movement of the spheres into the circumferential groove of the spherical tip.

* * * * *